US005549301A

United States Patent [19]

Gerrard

[11] Patent Number: 5,549,301

[45] Date of Patent: Aug. 27, 1996

[54] CARD GAME USING CARDS HAVING PICTURES OF SCENES AND ACTIVITIES ASSOCIATED WITH DIFFERENT ROOMS IN A HOME

[76] Inventor: Barbara Gerrard, 9729 6th Ave., Inglewood, Calif. 90305

[21] Appl. No.: 403,053

[22] Filed: Mar. 13, 1995

[51] Int. Cl.[6] ..... A63F 1/00

[52] U.S. Cl. ..... 273/305; 273/303; 273/308; 273/302

[58] Field of Search ..... 273/292, 303–306, 273/308, 302

[56] References Cited

U.S. PATENT DOCUMENTS

| | | | |
|---|---|---|---|
| 1,357,166 | 10/1920 | Hart | 273/303 |
| 1,695,425 | 12/1928 | Hartnacke | 273/308 |
| 3,072,408 | 1/1963 | Haak | 273/303 |

FOREIGN PATENT DOCUMENTS

| | | | |
|---|---|---|---|
| 1086030 | 10/1967 | United Kingdom | 273/303 |

*Primary Examiner*—Benjamin H. Layno
*Attorney, Agent, or Firm*—Erik M. Arnhem

[57] ABSTRACT

A card game includes seventy two cards in six different categories or sets. The cards in each set are numbered consecutively from one to twelve; cards in the range from one to six constitute the low numbered cards, whereas cards in the range from seven to twelve constitute the high numbered cards. The game includes a bidding phase, and a playing phase. During the bidding phase the players predict, or claim, the number of tricks that they will take. During the playing phase the players play cards individually, to win tricks according to the number value on the respective cards. The winning bidder determines whether the play will take place with the low numbered cards or the high numbered cards.

7 Claims, 6 Drawing Sheets

CARD GAME USING CARDS HAVING PICTURES OF SCENES AND ACTIVITIES ASSOCIATED WITH DIFFERENT ROOMS IN A HOME

BACKGROUND AND SUMMARY OF THE INVENTION

This invention relates to a card game identified by the name 'Old Acquantances', (a trademark owned by Applicant and presently pending in the U.S. Patent and Trademark Office) wherein an equal number of cards are dealt to each player, and wherein each player makes a claim or prediction as to the number of tricks (or winning hands) that the player expects to take. The player predicting the highest number of tricks is considered to be the claimer (or bidder). If four players are playing the game, the bidder and the person sitting directly across the table (termed the partner) work as a team to take at least the number of winning hands claimed by the bidder; the other two players (the opponents) work as a team to prevent the bidder and partner from taking the predicted number of tricks.

If there are five players in the game, all players work alone, making the bidder dependent on exchange cards to make the bid. The other players become partners whenever there are 4 to 6 players and work as a team to prevent the successful bidder from taking the preducted number of tricks with 4 or 6 players.

The game is played with six sets of cards containing pictures of activities and scenes associated with different rooms in a home, e.g. the library, living room, dining room, kitchen, bedroom and bathroom. In preferred practice of the invention, each set of cards is numbered consecutively from one to twelve. There are thus seventy two cards in the deck of cards, i.e., six sets of cards, with each set containing twelve cards.

The library cards are arbitrarily termed trump cards, i.e. cards that can be played over cards of a different set to win the hand (or trick).

Each set of cards may be likened to a suit in a conventional deck of cards. When the cards are played, each player is required to follow suit, i.e. to play a card in the set (or suit) played by the leading player, unless the person has no cards in the set being played. In that case the person can attempt to trump the cards played (by playing a card from the library set), or the person can discard a card from a different set.

In preferred practice of the invention, the cards in each set are divided into two groups. A first group of low-numbered cards comprises six cards numbered consecutively from 1 through 6; a second group of high numbered cards comprises six other cards numbered consecutively from 7 through 12. The six low numbered cards in each set can be colored differently than the six high numbered cards, to facilitate the process of more easily distinguishing the low numbered cards from the high numbered cards.

The game is played so that each winning trick is either a high numbered card or a low numbered card (not both). During the bidding process (prior to playing the cards to win tricks) each player announces whether he or she intends to play the low numbered cards or the high numbered cards. Each winning trick is ordinarily a low numbered card, or a high numbered card, depending on the announced selection by the successful bidder. Players can discard cards in the non-elected group, but such cards will not determine the winning outcome. For example, if the successful bidder announces that he or she intends to play the low numbered cards (numbered 1 through 6) then cards numbered 7 through 12 will not be considered when determining the winner of any given trick. Conversely, if the successful bidder announces that he or she intends to play the high numbered cards, then the low numbered cards will not be considered when determining the winner.

An exception to this "low number-high number" selection process is in the use of library cards. The library cards are trump cards that can be used whether the successful bidder is playing the low numbered cards or the high numbered cards.

The grouping of the cards into the low numbered group and the high numbered group adds some interest to the game in that it introduces an element of strategy that would otherwise not be present. In an ordinary card game, when a player is dealt cards in the low numbered range, e.g. numbered from 1 to 6, the player has minimal opportunity for winning the game, since all, or most, of the tricks will be taken by the high numbered cards (i.e. 7 or above). With my proposed game format, a player receiving primarily low numbered cards can still bid, on the basis that he or she will be winning tricks with the low numbered cards.

As noted previously, the playing cards contain pictures of activities or scenes associated with different rooms in the home; e.g. the library, living room, dining room, kitchen, bedroom, and bathroom. The pictures depict activities and events that might have occurred in the late nineteenth or early twentieth century. Persons playing the game are given an insight into the clothing, customs and activities of persons living at the turn of the century. The pictures concentrate on family values associated with arts and crafts, etiquette, family prayer, bedtime stories, baking, canning, family discussions and other activities of worthwhile nature.

During the playing of the game, the older players have the opportunity of explaining how life was at the turn of the century. The younger players learn some of parents' history and early life experiences, as an incidental facet of the game. The game is designed to promote family unity and understanding.

To add further interest to the game, and particularly the historical feature of the game, the rules of the game may provide that the library cards can be used as trump cards only when the picture on the library card bears some relationship to the picture on the card being trumped. For example, a library card dealing with history could be used to trump a card in the living room set depicting a father playing chess with his son. Chess has a historical beginning, so that the two cards are related in a so-called historical sense.

The use of relationships, as a prerequisite for using the library cards as trump cards, adds interest to the game in that it forces the players to give some thought to relationships and events depicted on the cards. The game has a teaching aspect, as well as a strategy aspect.

Various rules and practices may be established to facilitate the orderly playing of the game. The nature of the game may be more completely understood by referring to the attached drawings, which show game cards used in an illustrative embodiment of the invention.

THE DRAWINGS

FIG. 1 shows twelve numbered cards in the library set of cards.

FIG. 2 shows twelve numbered cards in the living room set of cards.

FIG. 3 shows twelve numbered cards constituting the dining room set of cards.

FIG. 4 shows twelve numbered cards constituting the kitchen set of cards.

FIG. 5 shows twelve numbered cards that comprise a set of bedroom cards.

FIG. 6 shows twelve numbered cards related to events or activities associated with the bathroom.

Figure 1:
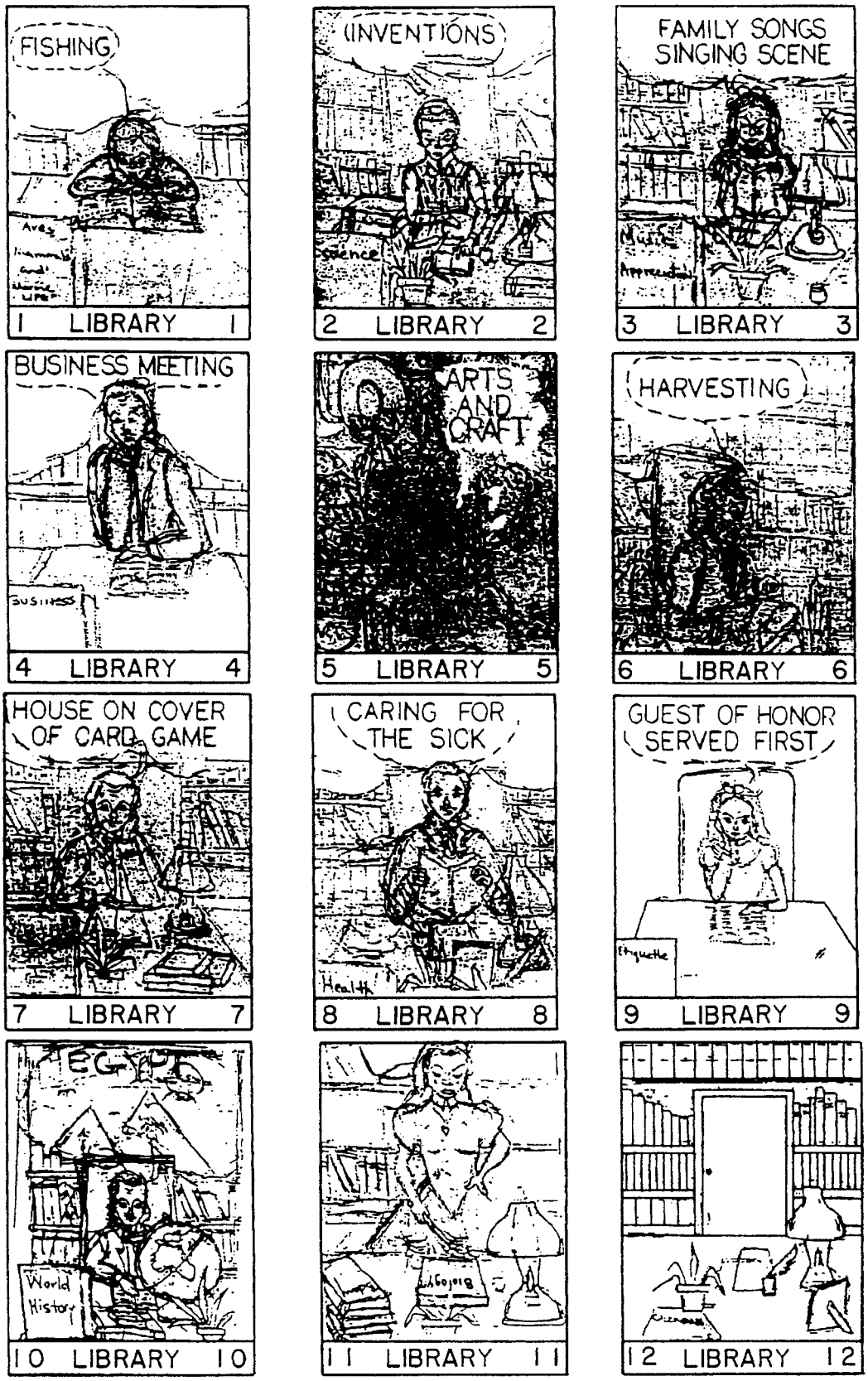
FIGS. 1 through 6 illustrate six sets of game cards useful in practice of the invention.

Referring to FIG. 1, the sequentially numbered cards have pictures showing various activities and events occurring in the library of a home. The persons in these pictures have clothing common to an earlier era, ranging from the late nineteenth century to the early twentieth century. The respective numbered cards depict the following areas of interest:

Card No. 1—birds, mammals and marine life

Card No. 2—science and inventions

Card No. 3—music

Card No. 4—business and commerce

Card No. 5—arts and crafts

Card No. 6—agriculture

Card No. 7—architecture

Card No. 8—health and medicine

Card No. 9—etiquette

Card No. 10—history

Card No. 11—cleaning and housekeeping

Card No. 12—organization of the library

Figure 2:
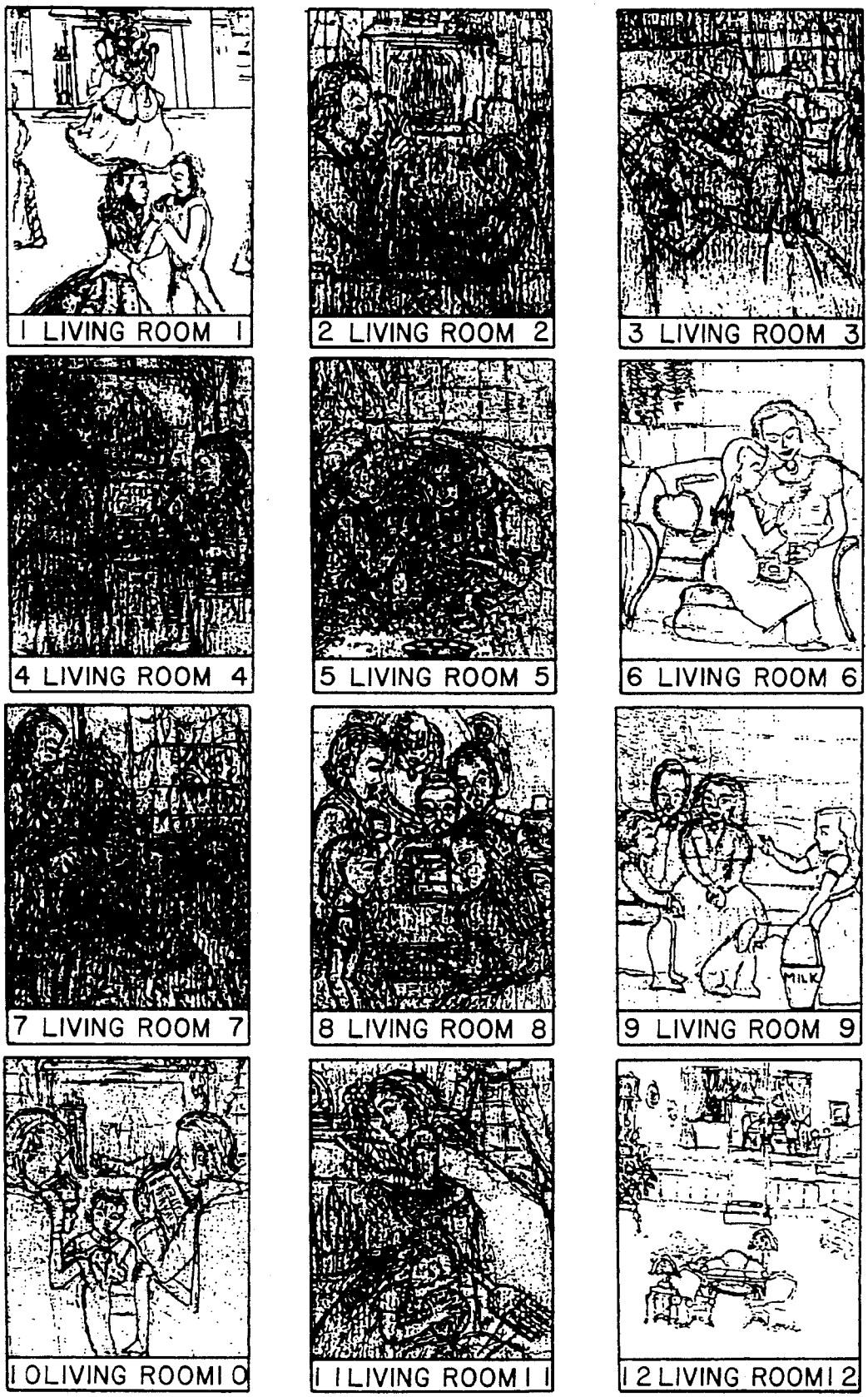

Referring to FIG. 2, the sequentially numbered cards have pictures showing the following activities or events associated With the living room.

Card No. 1—dancing

Card No. 2—father and son carving wood

Card No. 3—young artist painting a picture

Card No. 4—father and son playing a Game of chess

Card No. 5—women enjoying a tea party

Card No. 6—mother and daughter doing needle work

Card No. 7—men in a business meeting

Card No. 8—family singing around a piano

Card No. 9—family discussion

Card No. 10—family reading

Card No. 11—cleaning the room

Card No. 12—organization of the living room

Figure 3:
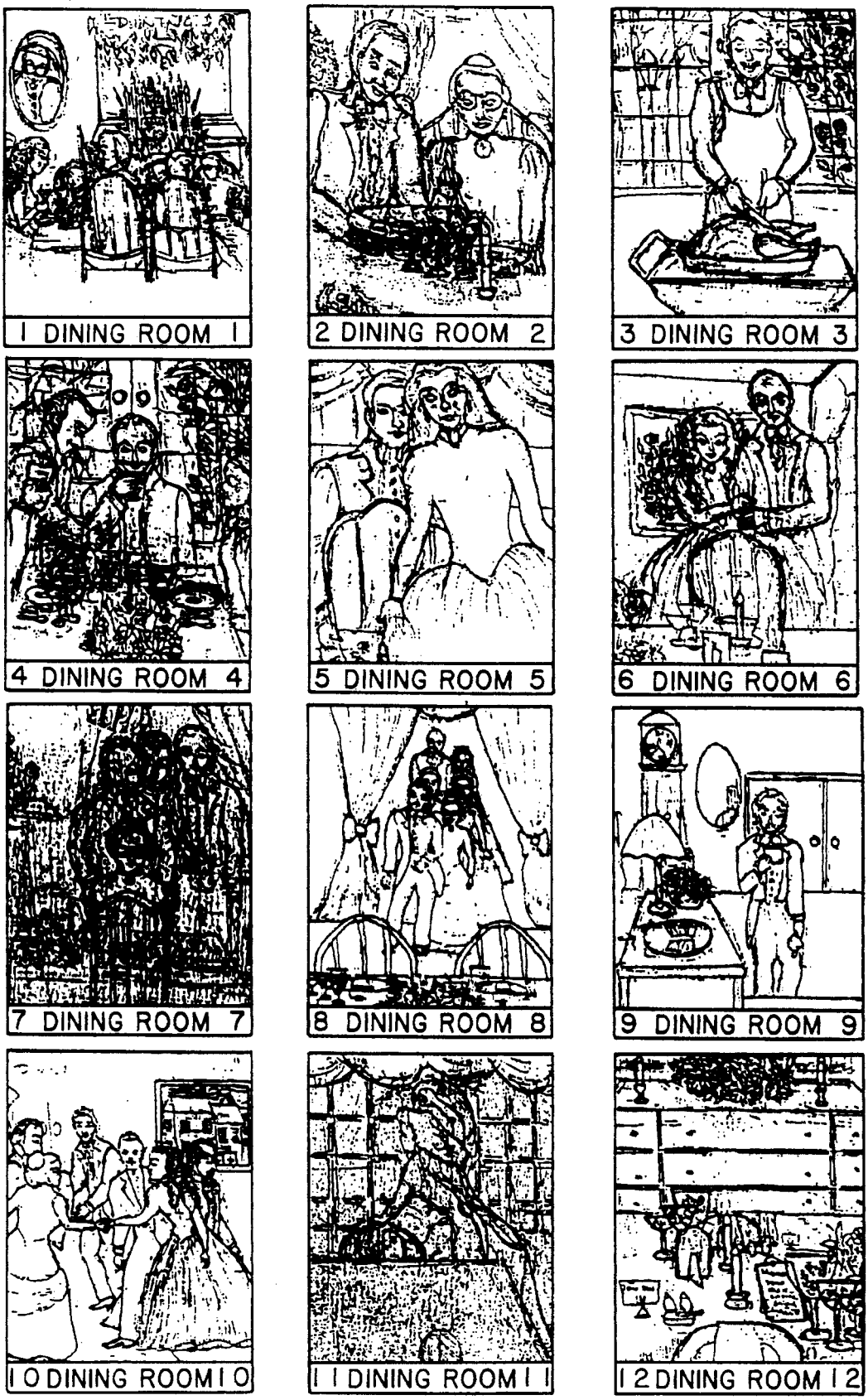

Referring to FIG. 3, there is shown a set of twelve numbered cards having pictures depicting various activities associated with the dining room in a home. The respective cards illustrate the following activities:

Card No. 1—family discussion around the table

Card No. 2—guest of honor being served

Card No. 3—host carving the meat

Card No. 4—host tasting the wine

Card No. 5—hostess being seated

Card No. 6—guest being escorted to the table

Card No. 7—eldest woman being seated first

Card No. 8—host escorting guest of honor to seat

Card No. 9—guest studying place card

Card No. 10—host and hostess greeting guests

Card No. 11—cleaning the room

Card No. 12—organization of the dining room

Figure 4:
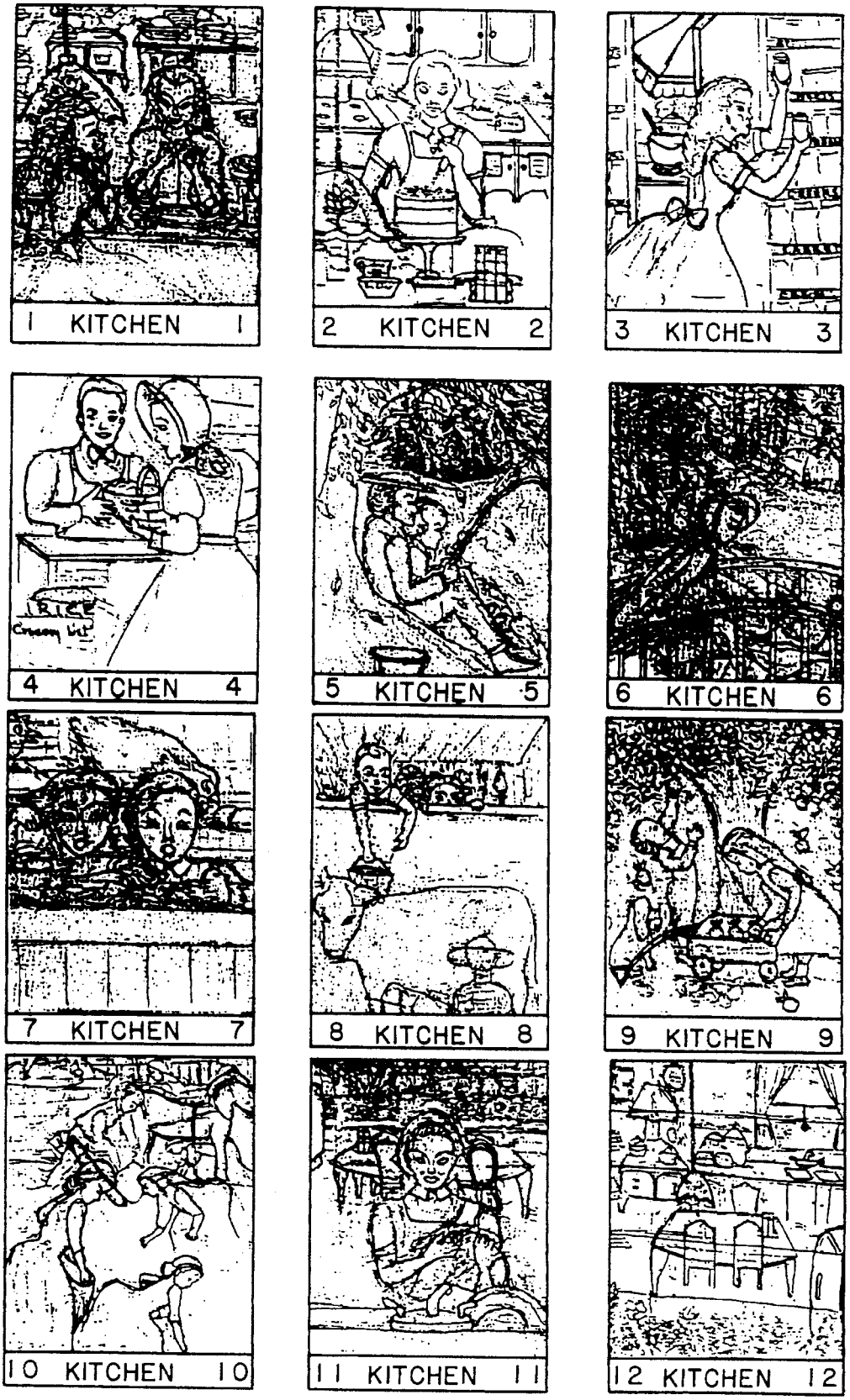

Referring to FIG. 4, there is shown a set of twelve cards depicting various activities related to the kitchen or food gathering process. The respective cards show the following activities:

Card No. 1—discussion and preparation at the table

Card No. 2—cake baking

Card No. 3—canning

Card No. 4—bartering with the grocer

Card No. 5—fishing at a creek

Card No. 6—herding ducks across a bridge

Card No. 7—gathering eggs

Card No. 8—milking the cow

Card No. 9—picking and gathering fruit

Card No. 10—gleaning and harvesting

Card No. 11—cleaning dishes

Card No. 12—organization of the kitchen

Figure 5:
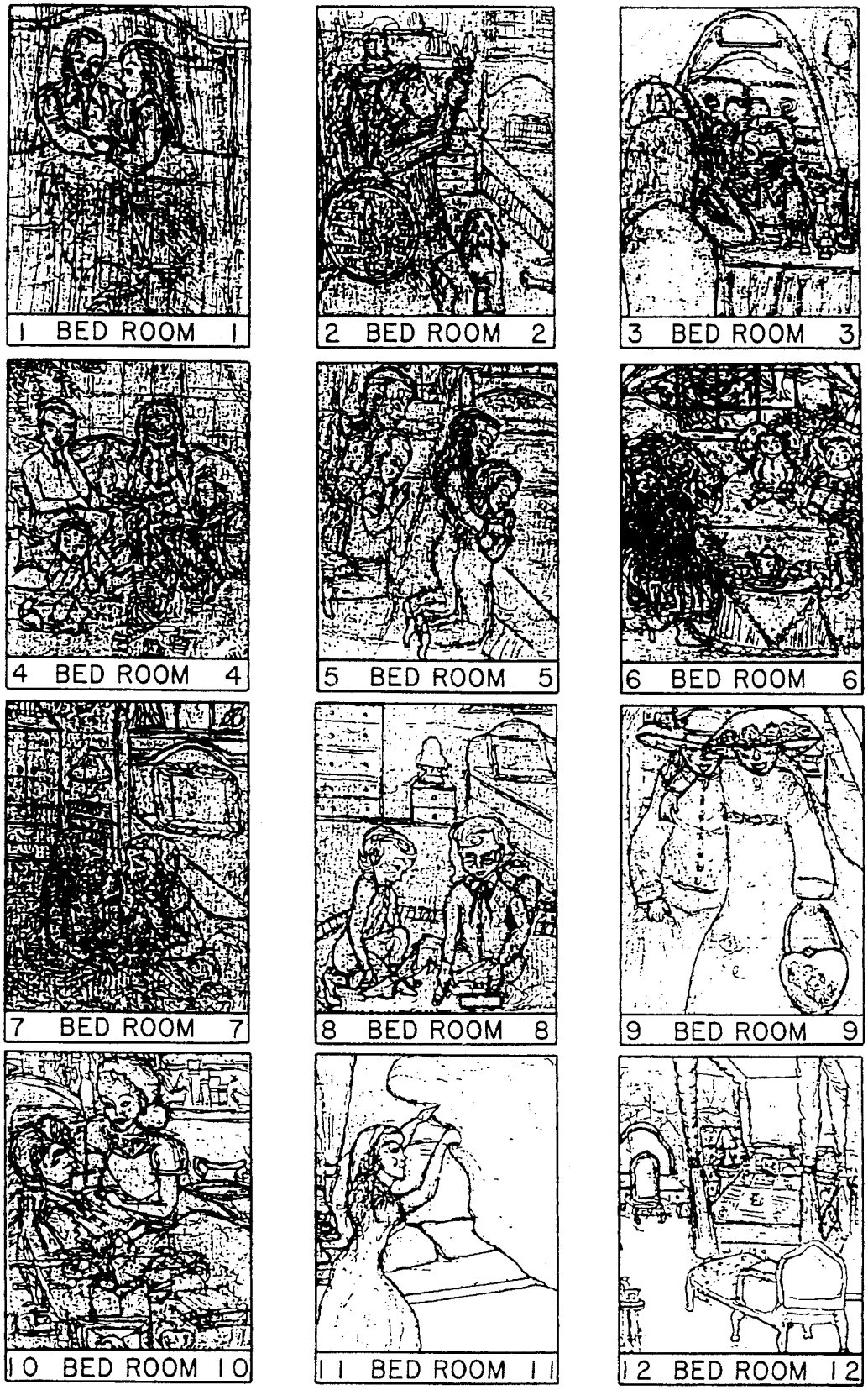

Referring to FIG. 5, there is shown a set of twelve cards containing pictures of scenes or events taking place in the bedroom.

Card No. 1—mother and father together at the end of the day

Card No. 2—starting the day with the alarm clock

Card No. 3—daughter applying make up

Card No. 4—family prayer

Card No. 5—reading bedtime stories

Card No. 6—playing with dolls

Card No. 7—girls sharing secrets in the bedroom

Card No. 8—boys learning the mechanics of trains

Card No. 9—girls dressing up

Card No. 10—caring for the sick

Card No. 11—cleaning the bedroom

Card No. 12—organization of the bedroom

Figure 6:
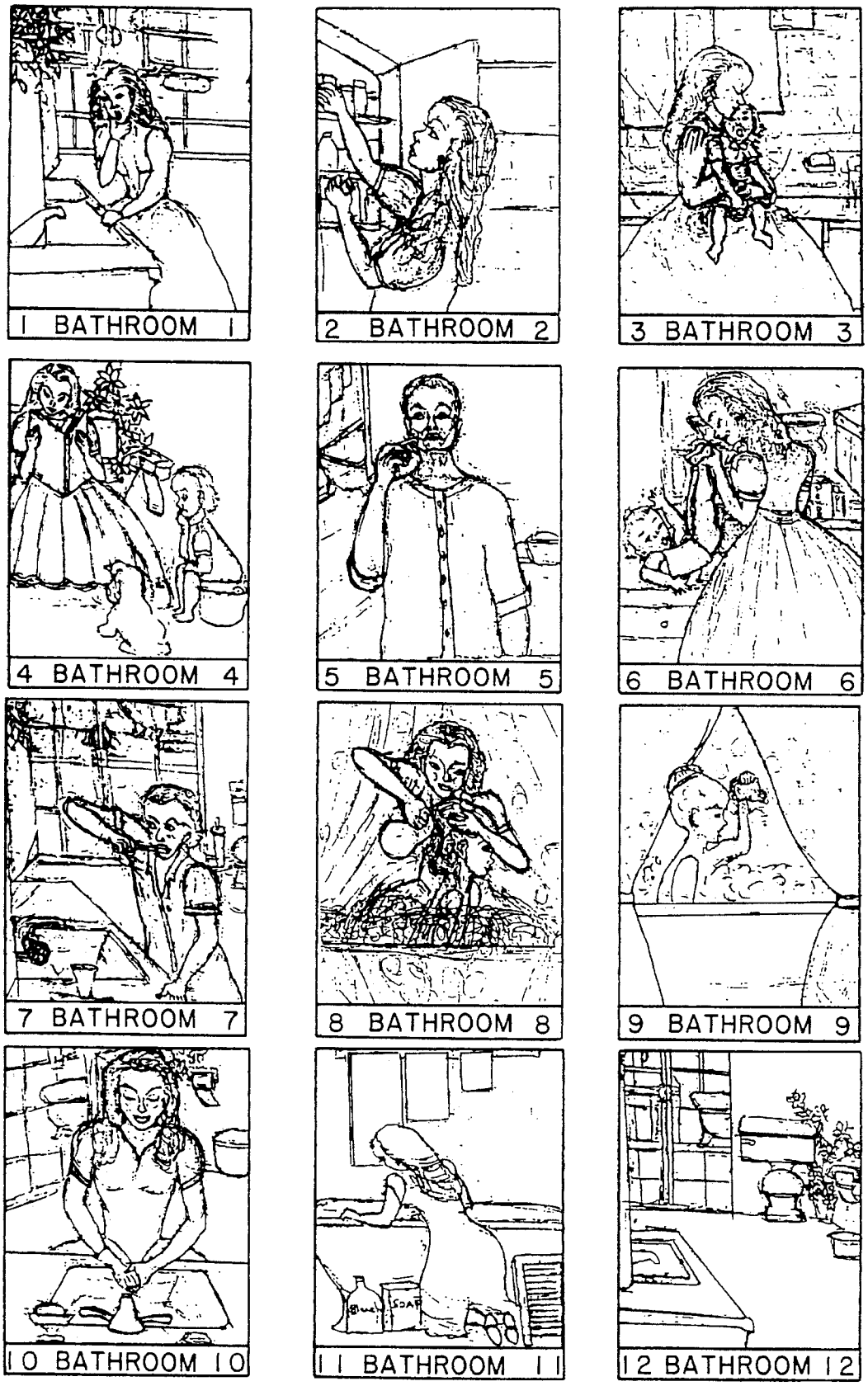

FIG. 6 shows a set of twelve cards illustrating the bathroom and related activities, as follows:

Card No. 1—young lady using the lavatory basin, "unchoking" herself from the dinner table Card No. 2—using the medicine cabinet Card No. 3—treating a child with croup Card No. 4—potty training Card No. 5—shaving Card No. 6—diaper changing Card No. 7—brushing teeth Card No. 8—shampooing hair Card No. 9—bubble bath Card No. 10—washing hands Card No. 11—cleaning the bathroom Card No. 12—organization of the bathroom FIGS. 1 through 6 show six sets of cards, depicting activities and room decor associated with six rooms in a home. The clothing and decor are representative of conditions in an earlier era, near the end of the nineteenth century and the beginning of the twentieth century. The pictures on the cards educate the younger generation as to life and customs in the earlier era, so that the younger generation can better appreciate the joys and difficulties experienced by the older generation. The figures and scenes on the cards are preferably multi-colored to add interest and realism.

There are twelve cards in each set of cards, such that there is a total of seventy two cards. The cards in each set are numbered consecutively from 1 to 12. The cards in each set numbered from 1 to 6 are considered to be low numbered cards. The cards in each set numbered 7 to 12 are considered to be high numbered cards. In order to distinguish the high numbered cards from-the low numbered cards, the coloring of the cards can be different for the different types of cards. For example the background on the title portion of the low numbered cards can be light blue, whereas the background on the title portion of the high numbered cards can be pale pink, such that the players can readily differentiate the high numbered cards from the low numbered cards.

The cards may be used in a game that somewhat resembles the well known game of bridge. In playing the game there are two phases, namely the bidding phase and the playing phase (wherein the players place cards face up on the table in an effort to win tricks). The game is usually played by four persons, although it can be played by less than four persons or by more than four persons, e.g. three persons, five persons, or six persons. Each set of cards can be analogous to a suit in a conventional deck of cards. The cards in the library set serve as trump cards.

During the bidding phase each player, in sequence, predicts or claims the number of trick he or she will take during the playing phase. The player bidding the highest number of tricks is the successful bidder, or claimer. If there are four players, the successful bidder and the person sitting directly across from the successful bidder (termed the partner) work as a team to take the maximum number of tricks. The other two players (termed the opponents) work as a team to prevent the bidder and his/her partner from taking the predicted number of tricks.

If there are less than five players, each player works alone (no partners). The successful bidder is then opposed by the other players. 4 to 6 players are partners.

A trick is taken according to the numbers on the cards being played; the higher numbered card will take the trick over the lower numbered card. Also, the trick is won according to the room designation on the cards. For example, if one player plays a ten card in the living room set, the next player can overcome the ten by playing an eleven or twelve card in the living room card set (or by trumping with a library card). The ten card in the living room set cannot be overcome with a higher card in a different set, e.g. the bedroom set or dining room set. The players are required to follow suit, if possible. Thus, if the first player plays a card in the dining room set, the other players have to play dining room cards if they have such cards in their hands. If they do not have any dining room cards, they can discard cards of a different set, e.g. a bathroom card or a living room card.

The rules of the game provide that the successful bidder determines whether tricks will be won with the high numbered cards (i.e. cards numbered from 7 to 12) or the low numbered cards (i.e. cards numbered from 1 to 6). Cards in the non-elected range can be played, but they will not be applicable to the taking of a trick. This feature introduces a strategic aspect to the game, in that a person having predominately low cards can be a successful bidder, providing an appropriate strategy is used.

The game is started by dealing 10 cards to 6 players, 12 cards to 5 players and 15 cards to 4 players face down to each player. Assuming there are four players, there will be a total of 60 cards dealt to the players. The remaining 12 cards are left face down on the table to provide an exchange pack of cards. This exchange pack always contains 12 cards.

The players examine their cards and then bid the number of tricks that each expects to take if he/she is the successful bidder; each player announces the number of tricks he/she expects to take, the major set (or suit) which he/she will play, and the card numbers (high or low) that will be used. The successful bidder is the player announcing the highest number of tricks. Various rules can be established to cover situations where two players bid, or announce, the same number of tricks. For example, one set can be considered superior to another set for bidding purposes. Thus, the living room set could be considered superior to the kitchen set when evaluating equal bids. Also, a bid using high number cards could be considered superior to another equal bid using low number cards.

Following the bidding phase, the successful bidder has the opportunity to discard cards he/she considers to have no value, and to take an equal number of cards from the exchange pack. Typically, the rules permit the successful bidder to discard up to 12 cards and take 12 other cards from the exchange pack in order to increase the chances for winning tricks in the playing phase.

The successful bidder begins the playing phase by playing a card face up on the table. The other players play cards in sequence, after which the highest card played is declared to be the winner unless a trump card is played. The process is repeated until all of the cards have been played. Each player is dealt twelve cards, such that the Game consists of twelve tricks. The Game is won or lost, depending on whether the successful bidder (and his/her partner) take the predicted number of tricks.

The rules of the Game require that the claimer (successful bidder) play cards from his elected set, as long as he/she has such cards. The "elected set", in this case, is the category or set announced by the bidder, e.g. the living room set or the dining room set.

As indicated previously, the successful bidder can elect to play the low numbered cards (1 through 6) or the high numbered cards (7 through 12). The non-elected cards will be played along with the elected number cards, but the non-elected cards will not count toward winning a trick. If a player plays a card in the non-elected number range, that card will be disregarded.

The playing process will rotate according to who wins each trick. A player winning one trick will begin the play for the next trick. If a player wins one trick, but does not have any cards in the elected number range (high number or low number) then the play will advance to the next player around the table. In this way there will always be a potential winning card to start each play.

As previously noted, the library cards are used as trump cards. The rules require that a trump card can be played only when the player is not able to follow suit, i.e. when the player does not have a card in the set (or suit) played by the lead off player. The high-low number limitations do not apply to the library cards (trump cards). Library trump cards cannot win category card #12 Organization and category card #11. All suits have these cards. As an example, category 12 living room trump card #12 Library, #12 living room card wins. A library card of any numerical value can be used as a trump card. In appropriate situations one player can overtrump another player, i.e. by playing a higher value trump card.

A player can elect to use the library cards as his/her major elected set (e.g. instead of the living room set, bedroom set, etc. In that event the game is played without any trump cards.

As a variation in the game rules, the use of library cards for trump card purposes can be restricted to situations wherein the particular library card used for trumping purposes has a relationship to the card being trumped. When a player announces that he/she is trumping another player's card with a particular library card, he/she must at the same time describe the relationship that is used as a basis for the trumping action.

This relationship is in the nature of a commonality of purpose or condition. For example the No. 11 library card has a commonality with any of the No. 11 cards in the other sets, in that all of the No. 11 cards deal with cleaning. Similarly, the No. 5 library card (arts and crafts) has a commonality with the No. 2 living room card. The scenes depicted in the various cards contain various areas of commonality that enable the library cards to be used as trump cards under the above-noted rule. The rule introduces an added feature to the game, whereby the players are required to mentally search for relationships and concepts in order to make most effective use of the cards dealt.

As noted previously, the game cards pictorially illustrate scenes and living conditions prevalent in an earlier era. The game thus serves as a teaching aid to instill in the younger generation a respect, knowledge and reverence for the older generation.

The "Old Acquantices" Library Game is designed to replace boredom with tantalizing effect towards creativity, joy and family unity that can be an obtainable reality in the home today, as it was in past times. The game shows family life in the 18th and 19th century, involving the activities of daily living by means of pictures.

The drawings show particular features and illustrations used in a specific embodiment of the invention. However, it will be appreciated that variations in game card content can be employed while still practicing the invention.

What is claimed is:

1. A card game wherein numbered cards are played in sequence to produce winning hands, and wherein each player predicts the number of winning hands by the respective player, prior to the cards being played; said card game comprising:

a multiplicity of numbered playing cards containing pictures of activities and scenes associated with different rooms in a home;

each card having the name of a particular room printed thereon, together with a number representing the value of the card; all cards having the same room printed thereon constituting one set of cards wherein there are a plurality of sets of cards;

the cards in each set being numbered consecutively from a minimum numerical value up to a maximum numerical value; each set of cards having the same number of cards and the same range of numerical values;

each set of cards comprising a first group of low numbered cards, and a second group of high numbered cards; the number of low numbered cards in each group being the same as the number of high numbered cards wherein the low numbered cards in each set are colored differently than the high numbered cards;

said card game including rules that require each player to select either the low numbered cards or the high numbered cards for use in achieving a winning hand.

2. The card game of claim 1, wherein the cards in one particular set are wild cards that can be used as trump cards when the cards are played.

3. The card game of claim 1, wherein there are six sets of cards.

4. The card game of claim 3, wherein the six sets of cards are titled with the names library, living room, dining room, kitchen, bedroom and bathroom.

5. The card game of claim 4, wherein there are twelve cards in each set.

6. The card game of claim 5, wherein the cards in each set are numbered consecutively from one to twelve.

7. The card game of claim 1, wherein the pictures on the cards depict life as it existed at the turn of the century.

* * * * *